United States Patent [19]

Notaro et al.

[11] Patent Number: 4,664,429

[45] Date of Patent: May 12, 1987

[54] DELAYED RELEASE LOCKING CONTROL DEIVCE, PARTICULARLY FOR DOORS OF WASHING MACHINES AND THE LIKE

[75] Inventors: Giuseppe Notaro, Pomigliano D'Arco; Giancarlo Attena, Naples, both of Italy

[73] Assignee: Texas Instruments Incorporated, Dallas, Tex.

[21] Appl. No.: 737,115

[22] Filed: May 23, 1985

[30] Foreign Application Priority Data

Jun. 22, 1984 [IT] Italy ..... 48444 A/84

[51] Int. Cl.[4] ..... E05C 03/06

[52] U.S. Cl. ..... 292/201; 292/DIG. 66; 292/DIG. 69

[58] Field of Search ..... 292/DIG. 66, DIG. 69, 292/201; 49/1, 7, 9

[56] References Cited

U.S. PATENT DOCUMENTS

| | | | |
|---|---|---|---|
| 3,815,942 | 6/1974 | White | 292/201 X |
| 3,884,056 | 5/1975 | East et al. | 292/197 X |
| 4,032,180 | 6/1977 | Pohl | 292/341.16 |
| 4,074,545 | 2/1978 | Case | 292/DIG. 69 X |
| 4,286,811 | 9/1981 | Schantz | 292/DIG. 69 X |

FOREIGN PATENT DOCUMENTS

| | | | |
|---|---|---|---|
| 2708086 | 9/1977 | Fed. Rep. of Germany | 292/DIG. 69 |
| 2756366 | 6/1979 | Fed. Rep. of Germany | 292/DIG. 69 |
| 1194065 | 6/1970 | United Kingdom | 70/134 |
| 2049020 | 12/1978 | United Kingdom | 292/DIG. 69 |

*Primary Examiner*—Robert L. Wolfe

*Attorney, Agent, or Firm*—James P. McAndrews; John A. Haug; Melvin Sharp

[57] ABSTRACT

Delayed release locking control device, particularly for doors of washing machines and the like, containing inside a case a self-regulating resistive wafer heater of a material having a positive temperature coefficient (PTC) of resistance, a snap-acting bimetallic element connected to a latch or locking member, and terminals which carry electrical current to the PTC wafer heater, wherein the bimetallic element is arranged so means transform the linear snap like movement of an end of the bimetallic element into a rotary movement of the latch mounted on the case to cause it to rotate 90° from a resting position into an operating position when the bimetallic element, selectively heated by the said PTC wafer, abruptly reverses its curvature upon reaching the actuating temperature of reversal and to cause the said latch to return to the resting position when the bimetallic element cools down again to below a reset temperature of reversal and snaps back to its normal curvature.

4 Claims, 9 Drawing Figures

DELAYED RELEASE LOCKING CONTROL DEIVCE, PARTICULARLY FOR DOORS OF WASHING MACHINES AND THE LIKE

BACKGROUND OF THE INVENTION

The present invention relates to a safety locking device for doors of washing machines, dishwashers and the like, which provides a high degree of fidelity and long life.

The problem underlying the present invention is already known. It concerns the provision of a safety locking device for doors of household appliances such as washing machines, dishwashers and the like, which comprises a moving member able to ensure the closure of the door while the machine is in operation so that the door can be opened only when the rotating mass of the machine comes to a complete stop after terminating machine operation.

The problem was solved in the prior art by using, for example, a bimetallic plate heated by a flow of electrical current by way of a PTC wafer heater and acting by means of other intermediary means on a linearly sliding latch or locking member.

However, the transformation of a linear snap like movement of the bimetallic plate into a longer linear movement of the locking member by means of said intermediary means involves a certain complexity of the structure of the device and, consequently, a higher cost of the same, aside from a greater space requirement that often creates mounting and assembling problems.

BRIEF SUMMARY OF THE INVENTION

An object of the present invention is therefore to provide a locking device for doors of washing machines and the like, which is of very simple design containing a smaller number of parts and is nevertheless able to assure maximum reliability.

This object is achieved according to the invention in that the bimetallic plate, heated in the manner known per se by preferably direct contact with the wafer of material having a positive temperature coefficient (PTC), is connected directly with a latch so as to transform its linear snap like movement into a 90° rotary movement of the latch to move the latter from the resting position into the locking position of the door of a washing machine and vice versa. The bimetallic plate is of the preformed type so as to have well defined curvature reversal temperatures and thus rapid snap-action reversals.

According to the invention, a door-locking device is provided comprising a case of plastic material, a PTC wafer disposed in a suitable cavity of the case with one of its faces arranged on an electrical terminal, a bimetallic plate disposed on the second face of the wafer, a second electrical terminal in contact with one of the ends of the said plate, and a latch rotatably mounted on a pin inside the said case and connected to the second end of said plate so that upon a reversal of the curvature of the plate the second end of the plate moves and causes the latch to rotate about the pin from the resting position to a locking position of the door for the washing machine.

After completion of the washing cycle of the machine and interruption of the electric current, the bimetallic plate starts to cool down and upon reaching the reversal temperature causes the said bimetallic plate to turn abruptly into its original position and thus releases by said abrupt movement the latch which executes a rapid rotary movement to return to its resting position, rotating 90° in the opposite direction in this releasing the door of the machine.

DESCRIPTION OF THE DRAWINGS

The invention will now be described with reference to two embodiments shown in the attached drawings, wherein.

DESCRIPTION OF PREFERRED EMBODIMENTS

Figure 1:
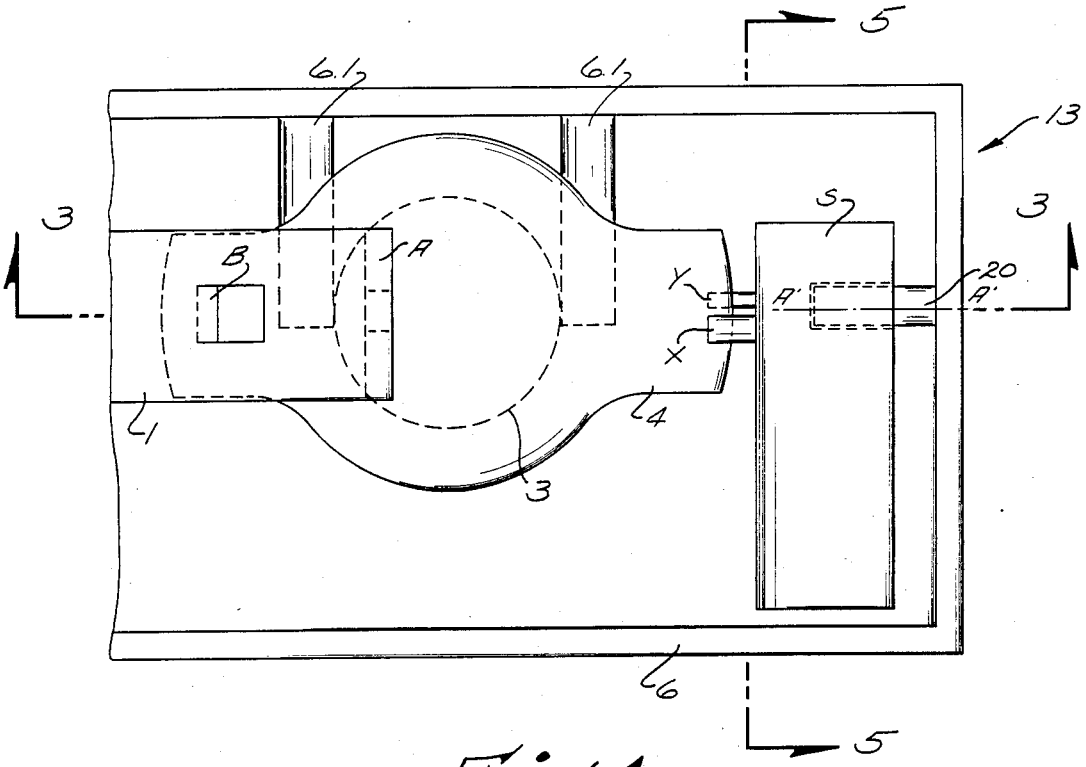
FIG. 1 shows a partial plan view of a first embodiment of the device according to the invention, with the latch or locking member of the device in a resting position.
Figure 2:
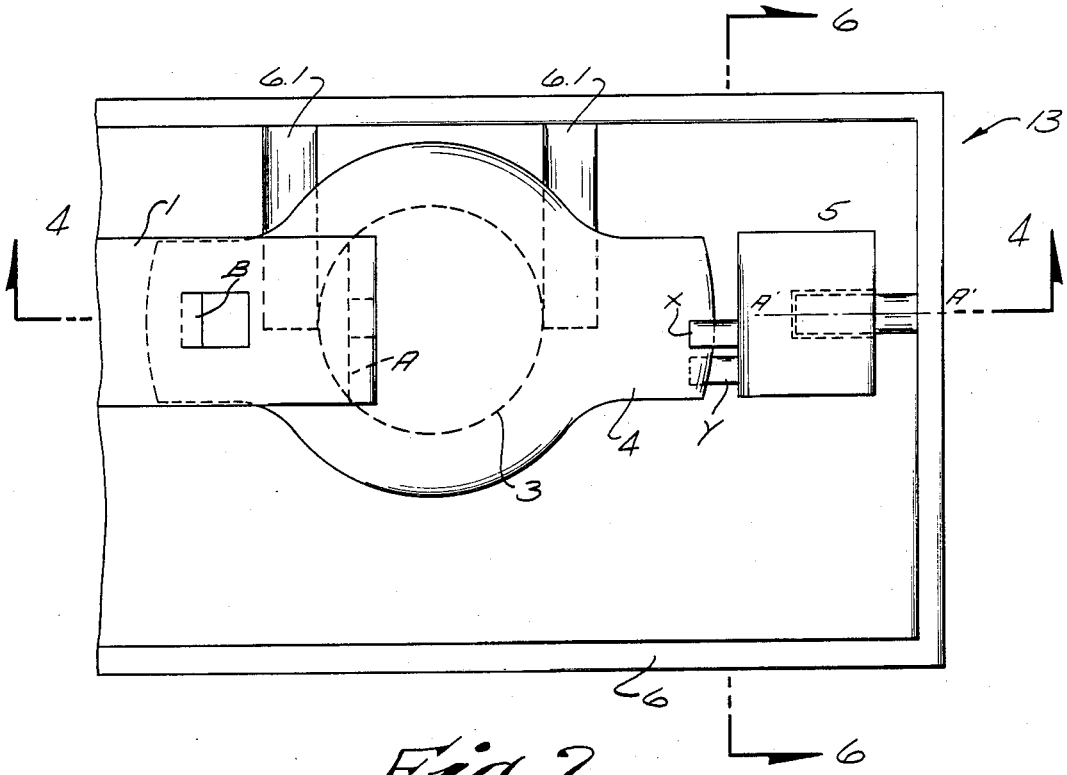
FIG. 2 shows a partial view similar to that of FIG. 1 with the latch in a locking position.
Figure 3:
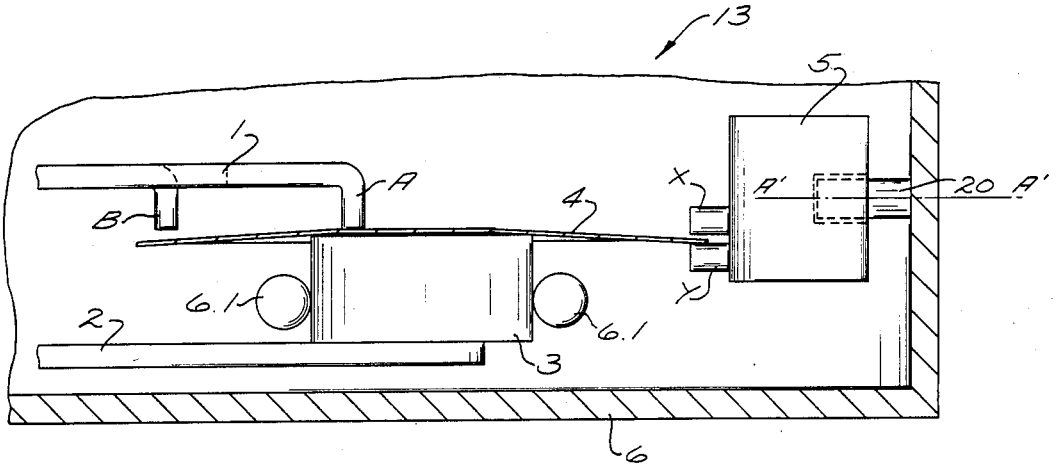
FIG. 3 shows a partial side section view of the said device along line 3—3 of FIG. 1 with the latch in the resting position.
Figure 4:
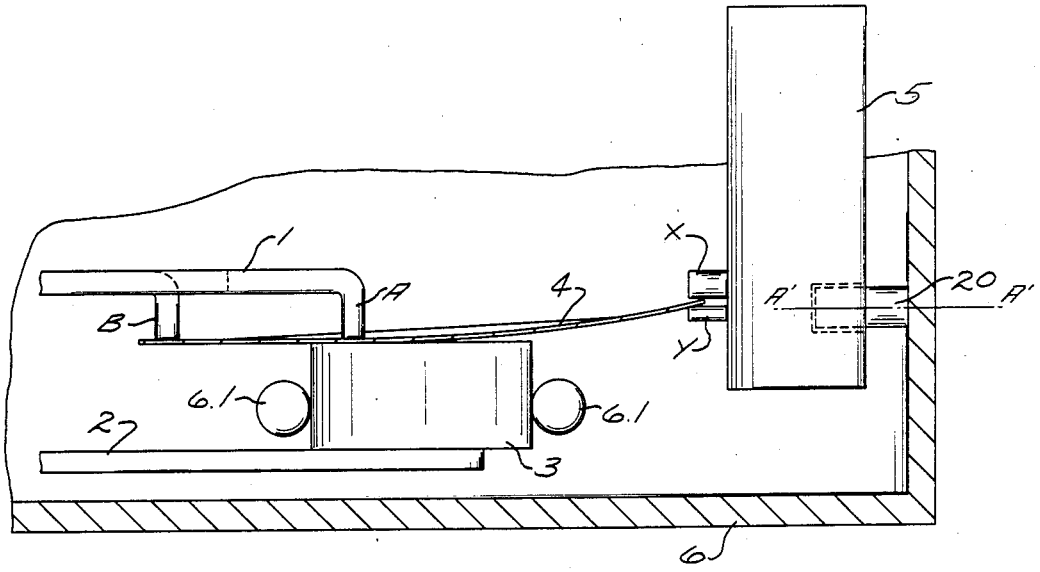
FIG. 4 shows a partial side section view of the said device along line 4—4 of FIG. 2 with the latch in the locking position.

As can be seen in FIGS. 1 through 4 illustrating one embodiment of the locking device 13 of this invention, one face of a wafer heater 3 of a ceramic resistive material or the like with a positive temperature coefficient (PTC) is disposed in electrical contact and in heat-transfer relation with a conventional, preformed, dished, thermally-responsive, snap-acting bimetallic plate 4 and the plate 4 is also disposed with a portion engaged in electrical contact with a first terminal 1. For clarity of illustration, only one layer of the bimetal plate 4 is illustrated in the drawings but it will be understood that the plate is of conventional multilayer thermostat metal adapted to move with snap action from the dished curvature shown in FIG. 3 to the inverted dished curvature shown in FIG. 4 when the plate is heated to a selected actuating temperature and to return to its original curvature with snap action when the plate is subsequently cooled to a selected reset temperature. One end of the plate 4 engages between two pins X and Y of a latch or control member 5 rotatably mounted by means of a pin 20 inside a case or base 6 of the device 13, the case 6 preferably being of an electrically insulating material and having electrically insulating wafer-locating means 6.1 formed on the case. The second face of wafer 3 is in contact with the second terminal 2 of the electric circuit of the device 13 as shown in FIGS. 3 and 4. In that way the wafer heater is adapted to be energized by current directed through the wafer between terminals 1 and 2 when a washing machine or the like is operated thereby to heat the bimetal plate 4. Because of the PTC characteristic of the heater material, the wafer heater 3 is self-regulating and remains at a safe but elevated temperature during operation of the washing machine or the like to keep the plate 4 heated.

Figure 5:
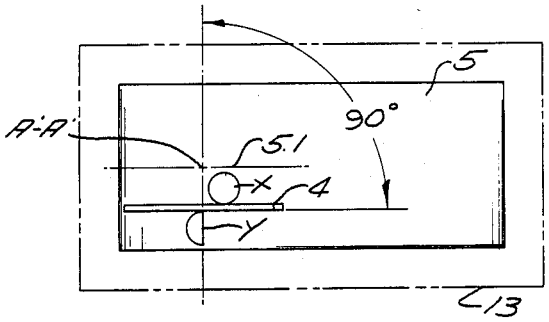
FIG. 5 shows a partial front section view of the latch in the resting position viewed along line 5—5 of FIG. 1 with two pins engaging an end of the bimetal plate.
Figure 6:
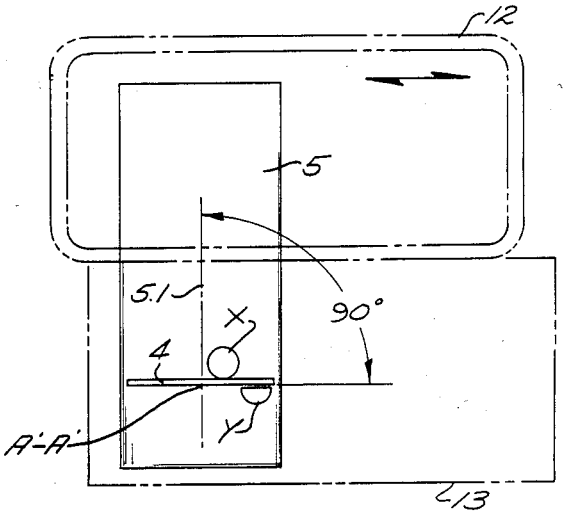
FIG. 6 shows a partial view similar to that of FIG. 5 along line 6—6 of FIG. 2 with the latch in the locking position.

The geometrical disposition and configuration of pins X and Y are shown in FIGS. 5 and 6. As can be seen from the same, pin X preferably has in this particular embodiment a circular cross section, while pin Y has a semicircular cross section. In the resting position when wafer 3 and bimetallic plate 4 are cold as illustrated in FIGS. 1, 3 and 5, the end of the plate 4 is inserted between pins X and Y and supports itself on the semicircular pin Y only along a line of contact with that pin.

When as a result of the electric current supplied and directed through the wafer 3 by terminals 1 and 2 the resistive wafer heater 2 heats up, the bimetallic plate 4 is also heated to its actuating temperature and snap-acting reversal of its curvature occurs, whereby the one end of said plate 4 jumps upward (as viewed in FIG. 5) exerting a pressure on pin X and thus causing latch 5 to rotate 90° about axis A'—A' of pin 20 to the operating position shown in FIGS. 2, and 4 and 6 in which plate 4 rests on flat side of pin Y and in which the latch 5 is adapted to restrict opening movement of a cursor 12 for a washing machine door or the like during operation of the washing machine as is diagrammatically illustrated in FIG. 6. At the end of the operating cycle of the washing machine and upon interruption of the washing machine electrical circuit so that the wafer heater is deenergized, the wafer 3 and plate 4 cool down and, upon the plate reaching its reset temperature, the opposite process takes place, the plate undergoing snap-acting reversal of its curvature back to its original curvature as shown in FIGS. 1, 3 and 5 so that the plate returns to its resting position, thus making latch 5 rotate 90° in the opposite direction and returning the latch to its resting position.

As is seen in FIGS. 5 and 6, the pins X, Y are both disposed on one side of a longitudinal plane 5.1 of symmetry through latch 5 located at various distances from that plane and spaced from each other about the thickness of the bimetallic plate 4 in the longitudinal direction of the latch 5. Pin 20 around which latch 5 rotates is disposed on the said longitudinal plane of symmetry of latch 5 above pin Y in the resting position of the latch 5.

Figure 7:
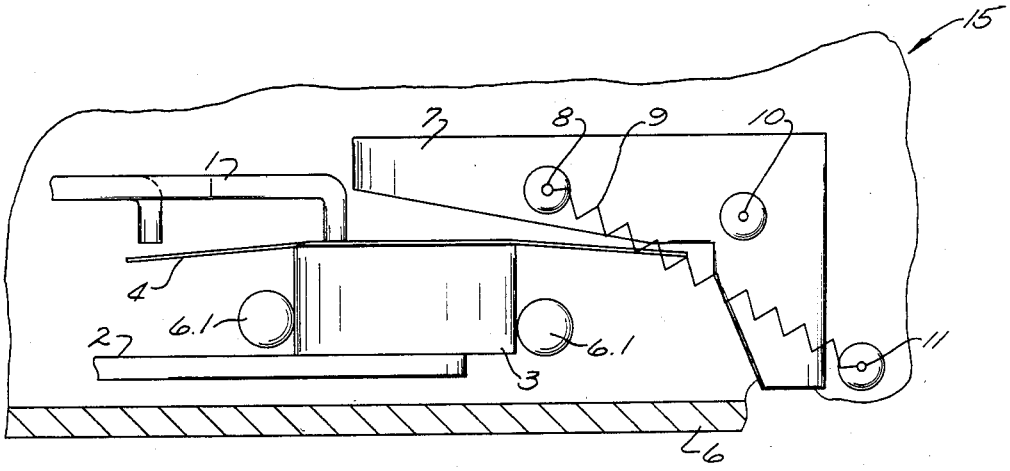
FIG. 7 shows a partial side section view of a second embodiment which is modified with respect to the configuration of the locking latch and the manner of engaging with the end of said bimetallic plate in the resting position of the latch.
Figure 8:
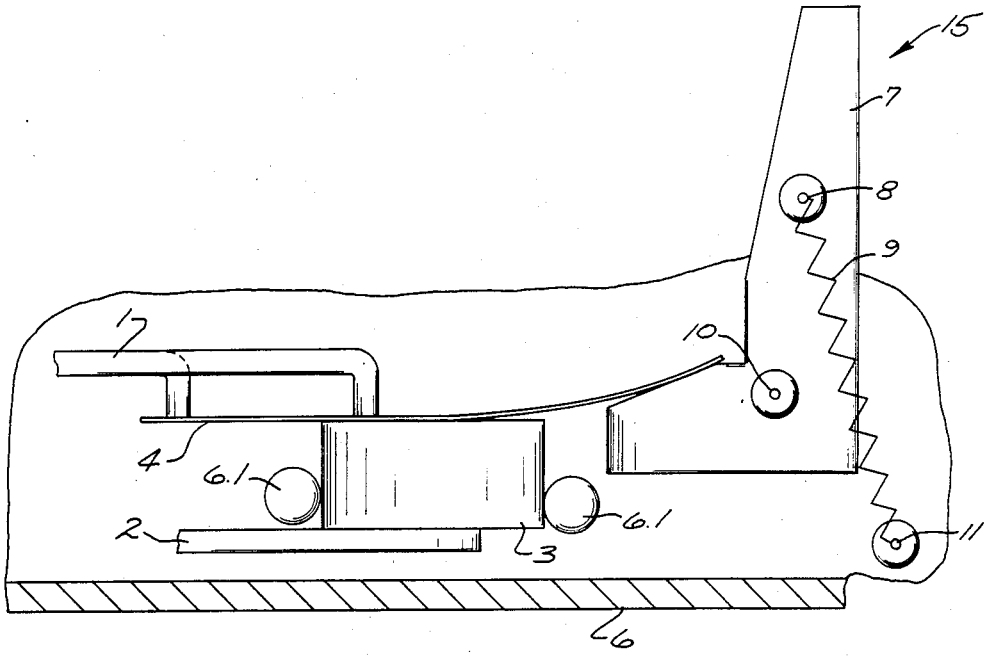
FIG. 8 shows the same partial view as in FIG. 7 with the latch in the locking position.
Figure 9:
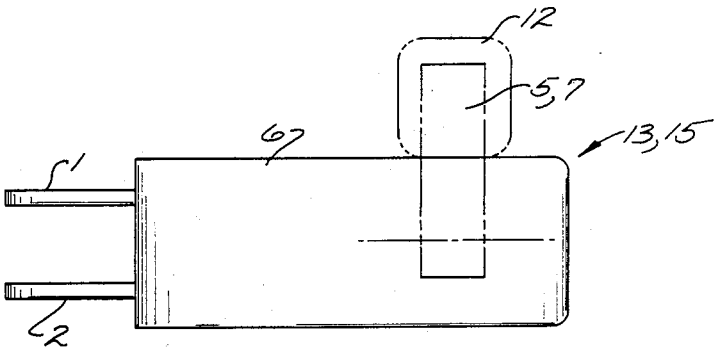
FIG. 9 shows shows an exterior side view of the device illustrating door locking using the device.

In the second embodiment 15 of the device of this invention shown in FIGS. 7, 8 and 9, a change is made in the configuration of the latch and in its manner of engaging with the end of the bimetallic plate.

In the device 15, the locking latch 7, shown in its resting position in FIG. 7, is shaped in the form of an L and is rotatably mounted to a side wall of case 6 of the device 15 by means of a pin 10. On the longer leg of the L-shaped latch 7 projects a pin 8 on which one end of a tension spring 9 is fastened, the spring having a second end which is fastened on a pin 11 integral with case 6. The one end of bimetallic plate 4, at the moment of reversal of its curvature in consequence of the heat transmitted by wafer 3, jumps upward and makes latch 7 rotate about pin 10 and slightly beyond a temporary position of alignment of the three pins 8, 10, and 11, at which point the bimetallic plate looses contact with the longer leg of the latch, the rotation of the latch then being completed to a total of 90° rotation by the tension action of spring 9 up to the locking position shown in FIG. 8 in which the bimetallic plate 4 engages the shorter leg of the L-shaped latch 7 as illustrated in FIG. 8.

Upon cooling down of wafer 3 and thus of bimetallic plate 4, the latter execute the operation in the opposite direction, bearing against the shorter latch leg and causing the latch 7 to move abruptly back to and slightly through a position where there is a temporary alignment of the three pins 8, 10 and 11, after which the latch 7 is further moved by way of the tension of the spring 9 until it assumes once again the resting position shown in FIG. 7.

In FIGS. 6 and 9, latch 5 or 7 is shown in its locking position and inserted in a cursor 12 which prevents opening of the lock of a door of a washing machine or the like.

The terminal 1 has in both embodiments of the invention an end A bent 90° so as to engage the bimetallic plate 4 and hold it firmly on the wafer 3. In terminal 1, another tooth B is also preferably provided for engaging an end of the bimetallic plate 4 at the moment when the bimetallic plate reverses its curvature to return to its original curvature after cooling, thereby aiding the action of the second end of the bimetallic plate in moving latches 5 and 7 back to their respective rest positions.

The device of the present invention allows selection of the length of the latch and the path of the latch in accordance with application requirements. The latch can be made to swing 90° around one of the mutually perpendicular shafts 20 or 10 for moving the latch from the locking position of the door of the machine to the resting position in which the door is released and can then be opened.

The present invention has been described by way of reference to preferred embodiments thereof. It should be understood however that various modifications and variations of the preferred embodiments can be made without departing from the scope of the present invention.

We claim:

1. A control device comprising a base, a control member rotatable on the base between resting and operating positions of the member, and a thermostat metal plate having one end movable with a generally linear movement in response to temperature changes, the thermostat metal plate having said one end engaged with the control member for moving the control member between said resting and operating positions in response to said temperature changes, characterized in that the thermostat metal plate has an original dished curvature, is movable with snap action to an inverted dished curvature when heated to selected actuating temperature, and is movable with snap action to return to its original dished curvature when subsequently cooled to a selected reset temperature, the thermostat metal plate being mounted with a portion of the thermostat metal plate engaged with the base while said one end of the thermostat metal plate is engaged with the control member so that said one end of the thermostat metal plate moves abruptly with said generally linear movement during said snap-acting movement of the thermostat metal plate for rapidly rotating the control member between said resting and operating positions.

2. A control device according to claim 1 further characterized in that the control member is rotatable through an arc of 90 degrees in a selected plane on an axis which extends normal to said plane toward the thermostat metal plate in moving between said resting and operating positions, a pair of pins extends from the control member toward the thermostat metal plate, the thermostat metal plate has said one end disposed between the pair of pins and arranged to move with said generally linear movement along said plane, and the pins extend from the control member at selected different spacings from said axis so that engagement of said one thermostat metal plate end with the pins during said snap-acting movement of the thermostat metal plate rotates the control member rapidly through said 90 degrees arc between said resting and operating positions.

3. A control device according to claim 2 further characterized in that a self-regulating resistive heater of a material having a positive temperature coefficient of resistivity is mounted on the base disposed in engagement with one of said portions of the thermostat metal plate in heat-transfer relation thereto, the heater having terminals for directing electrical current through the heater to selectively energize the heater for heating the thermostat metal plate to said selected actuating temperature.

4. A control device according to claim 1 further characterized in that the control member is L-shaped having a pair of legs angularly disposed in a plane meeting at an intersection, a first pin forms an axis at said intersection mounting the control member on the base for rotation through an arc of 90 degrees in said plane between said resting and operating positions, a pair of additional pins are mounted on one leg of the control member and on the base respectively to be moved through a position of alignment of the additional pins with the first pin during said rotation of the control member, a tension spring extends between the additional pins biasing the control member toward resting and operating positions of the control member respectively as rotation of the control member moves the pin on the control member leg through said position of alignment toward the respective control member position, and the thermostat metal plate has said one end extending between the angularly disposed control member legs to engage the control member so that engagement of said one thermostat metal plate end with the control member during said snap-acting movement of the thermostat metal plate rotates the control member in said plane to move the pin on the control member leg through said position of alignment toward a respective control member position to be rapidly moved through said 90 degrees arc to the respective control member position by the spring bias.

* * * * *